US011834625B2

(12) United States Patent
Kreis et al.

(10) Patent No.: US 11,834,625 B2
(45) Date of Patent: Dec. 5, 2023

(54) CLEANING AGENT PORTION FOR AUTOMATIC DISHWASHERS

(71) Applicant: Henkel AG & Co. KGaA, Duesseldorf (DE)

(72) Inventors: Michael Kreis, Leverkusen (DE); Thomas Paulus, Duesseldorf (DE); Thomas Doering, Dormagen (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 243 days.

(21) Appl. No.: 16/720,217

(22) Filed: Dec. 19, 2019

(65) Prior Publication Data

US 2020/0199487 A1 Jun. 25, 2020

(30) Foreign Application Priority Data

Dec. 19, 2018 (DE) ..... 102018222240.1

(51) Int. Cl.

| | |
|---|---|
| ***C11D 3/20*** | (2006.01) |
| ***C11D 17/00*** | (2006.01) |
| ***C11D 1/08*** | (2006.01) |
| ***C11D 1/722*** | (2006.01) |
| ***C11D 3/08*** | (2006.01) |
| ***C11D 3/10*** | (2006.01) |
| ***C11D 3/37*** | (2006.01) |
| ***C11D 17/04*** | (2006.01) |
| ***C11D 3/04*** | (2006.01) |
| ***C11D 1/66*** | (2006.01) |

(52) U.S. Cl.

CPC ..... *C11D 1/08* (2013.01); *C11D 1/66* (2013.01); *C11D 1/722* (2013.01); *C11D 3/046* (2013.01); *C11D 3/08* (2013.01); *C11D 3/10* (2013.01); *C11D 3/2082* (2013.01); *C11D 3/3761* (2013.01); *C11D 17/0078* (2013.01); *C11D 17/0091* (2013.01); *C11D 17/042* (2013.01)

(58) Field of Classification Search

CPC ..... C11D 1/66; C11D 3/046; C11D 3/2082; C11D 17/0078; C11D 17/0082; C11D 17/0091

USPC ..... 510/224, 229, 441, 446, 477, 488

See application file for complete search history.

(56) References Cited

U.S. PATENT DOCUMENTS

| | | | | |
|---|---|---|---|---|
| 6,303,561 | B1 * | 10/2001 | Painter | C11D 17/0078 510/224 |
| 6,358,911 | B1 * | 3/2002 | Metzger-Groom | C11D 3/50 510/101 |
| 6,399,564 | B1 * | 6/2002 | Speed | C11D 17/0078 510/224 |
| 6,440,927 | B1 * | 8/2002 | Painter | C11D 3/0052 510/224 |
| 6,486,117 | B1 * | 11/2002 | Painter | C11D 3/0052 134/25.2 |
| 6,548,473 | B1 * | 4/2003 | Jacques Kamiel Thoen | C11D 3/386 134/25.2 |
| 2006/0172910 | A1 * | 8/2006 | Brooker | C11D 17/042 510/293 |
| 2017/0166846 | A1 * | 6/2017 | Boutique | C11D 17/043 |

FOREIGN PATENT DOCUMENTS

| | | | |
|---|---|---|---|
| EP | 1679363 | A1 | 12/2006 |
| WO | 03035819 | A1 | 5/2003 |
| WO | 2004013272 | A1 | 12/2004 |
| WO | 20070068920 | A1 | 6/2007 |
| WO | 2017050796 | A1 | 3/2017 |

OTHER PUBLICATIONS

European Search Report, EP19212052, dated Apr. 23, 2020.

* cited by examiner

*Primary Examiner* — Gregory R Delcotto

(74) *Attorney, Agent, or Firm* — Bojuan Deng

(57) ABSTRACT

A cleaning agent portion including a water-soluble wrapping and at least one composition for cleaning and/or caring for an automatic dishwasher, the composition containing at least i) an acid and/or ii) a buffer system consisting of at least one acid and at least one base, wherein the composition includes at least two parts, at least one part A being a compressed part and at least one part B being a non-compressed part or a further compressed part, an optionally compressed part B being compressed to a lesser extent than part A. The invention also relates to a method for producing the cleaning agent portions. The invention further relates to a method for cleaning and/or caring for an automatic dishwasher using the cleaning agent portion. The invention also relates to the use of and/or a method using the cleaning agent portion for cleaning and/or caring for an automatic dishwasher.

13 Claims, No Drawings

CLEANING AGENT PORTION FOR AUTOMATIC DISHWASHERS

FIELD OF THE INVENTION

The present invention relates to a cleaning agent portion for automatic dishwashers, which is effective against limescale and fat deposits in an automatic dishwasher and can be used together with an automatic dishwashing detergent in a normal dishwashing cycle without negatively impacting the cleaning performance of the dishwashing detergent, to a method for cleaning and/or caring for a dishwasher using said cleaning agent portion, and to the use of said cleaning agent portion and/or of the method for cleaning and/or caring for an automatic dishwasher. It also relates to a method for producing said cleaning agent portion.

BACKGROUND OF THE INVENTION

Limescale and fat deposits in an automatic dishwasher, resulting from use, are usually removed nowadays by means of special machine care agents. These special care agents contain acids for removing limescale and surfactants for removing fat. Owing to the acid contained, however, care agents of this kind have to be used in a separate program, since otherwise the cleaning performance of the neutral to alkaline dishwashing detergent is significantly reduced and the acidic agents can have a detrimental effect on decoration and glasses.

The use of care agents of this kind therefore increases the energy and water consumption. In addition, it is not particularly user-friendly to use said agents due to the additional time required.

BRIEF SUMMARY OF THE INVENTION

There is therefore a need for cleaning and care agents for automatic dishwashers which can be used in a normal cleaning cycle of a dishwasher together with a conventional dishwashing detergent without negatively impacting the cleaning performance of said detergent, and thereby resulting in adequate cleaning of and care for the dishwasher. At the same time, these cleaning and care agents should be appealing to the consumer and easy to use.

It has surprisingly been found that these problems can be solved by cleaning and care agents for the dishwasher which have two or more parts.

In a first aspect, the present invention is therefore directed to a cleaning agent portion comprising a water-soluble wrapping and at least one composition for cleaning and/or caring for an automatic dishwasher, the composition containing at least i) an acid and/or ii) a buffer system consisting of at least one acid and at least one base, wherein the composition comprises at least two parts, at least one part A being a compressed part and at least one part B being a non-compressed part or a further compressed part, an optionally compressed part B being compressed to a lesser extent than part A.

The present invention further relates to a method for producing cleaning agent portions, comprising:

a) providing a mold having at least one mold cavity;

b) adding a water-soluble film to the mold cavity;

c) forming an open chamber in the mold cavity by deforming the water-soluble film;

d) filling the open chamber with at least one particulate part B according to this application;

e) optionally increasing the bulk density of the particulate part B by 5 to 50%, preferably by 10 to 45%, particularly preferably by 15 to 40%, based on the bulk density of the non-compressed part B used to produce the cleaning agent portion;

f) optionally forming a cavity in part B;

g) filling the open chamber and/or the cavity in part B with a part A according to this application;

h) providing a second water-soluble film as a cover;

i) superimposing the open chamber and the cover in order to seal the portion pack at a sealing region;

j) sealing the cover with the open chamber.

The present invention further relates to a method for cleaning and/or caring for an automatic dishwasher using the claimed cleaning agent portion, wherein the cleaning agent portion is metered into the interior of the automatic dishwasher at the beginning of the cleaning cycle, preferably before the automatic dishwashing detergent.

The present invention also relates to the use of the claimed cleaning agent portion for cleaning and/or caring for an automatic dishwasher and/or of a method for cleaning and/or caring for an automatic dishwasher using the claimed cleaning agent portion for cleaning and/or caring for an automatic dishwasher.

"At least two," as used herein, includes, but is not limited to, 2, 3, 4, 5, 6 and more. "At least one," as used herein, includes, but is not limited to, 1, 2, 3, 4, 5, 6 and more.

Unless stated otherwise, the weight percentages given in this application relate to the active substance content in g, based on the weight of the entire composition in g.

"Normal cleaning cycle," as used herein, relates to a program for cleaning washware (dishes) of an automatic dishwasher. A cleaning cycle of this kind may include one or more pre-rinses, one or more main rinses, and one or more final rinses or drying stages. A cleaning cycle of this kind involves the automatic cleaning/rinsing of dirty washware or dishes.

DETAILED DESCRIPTION OF THE INVENTION

These and other aspects, features, and advantages of the invention will become apparent to a person skilled in the art through the study of the following detailed description and claims. Any feature from one aspect of the invention can be used in any other aspect of the invention. Furthermore, it will readily be understood that the examples contained herein are intended to describe and illustrate, but not to limit, the invention and that, in particular, the invention is not limited to these examples. Unless indicated otherwise, all percentages are indicated in terms of wt. %. Numerical ranges that are indicated in the format "from x to y" include the stated values. If several preferred numerical ranges are indicated in this format, it is readily understood that all ranges that result from the combination of the various endpoints are also included.

The embodiments described in the context of the agents according to the invention can readily be transferred to the methods and uses according to the invention, and vice versa.

In one aspect, the present invention is directed to a cleaning agent portion comprising a water-soluble wrapping and at least one composition for cleaning and/or caring for an automatic dishwasher, the composition containing at least i) an acid and/or ii) a buffer system consisting of at least one acid and at least one base, wherein the composition comprises at least two parts, at least one part A being a compressed part and at least one part B being a non-compressed part.

The at least one non-compressed part B, if provided in the composition, can be present in various forms. Without excluding other possibilities, liquids, gels, powders and other particulate mixtures should be mentioned here by way of example. If at least one non-compressed part B is contained in the composition, it is preferable for this to be a powdery and/or granular composition, particularly preferably a powder mixture.

In a further aspect, the present invention is directed to a cleaning agent portion comprising a water-soluble wrapping and at least one composition for cleaning and/or caring for an automatic dishwasher, the composition containing at least i) an acid and/or ii) a buffer system consisting of at least one acid and at least one base, wherein the composition comprises at least two parts, at least one part A being a compressed part and at least one part B being a further compressed part, the compressed part B being compressed to a lesser extent than part A.

Without being bound by a theory, both aspects of this invention ensure that part A dissolves in a delayed manner with respect to part B.

The wording "compressed parts" includes compacted, packed and/or squeezed parts.

It is preferable for part A to have been compressed at at least 8 kN/cm$^2$, particularly preferably at at least 10 kN/cm$^2$, in particular at at least 12 kN/cm$^2$. Most preferably, part A was compressed at 12 to 25 kN/cm$^2$.

It is also preferable for a part B, if contained in the cleaning agent portion in a compressed or compacted form, to be compressed by 5 to 50%, preferably by 10 to 45%, particularly preferably by 15 to 40%, based on the bulk density of the non-compressed part B used to produce the cleaning agent portion.

A preferred subject is therefore a claimed cleaning agent portion in which the composition comprises at least one compressed part A and at least one compressed part B and in which at least one compressed part B was compressed by 5 to 50%, preferably by 10 to 45%, particularly preferably by 15 to 40%, based on the bulk density of the non-compressed part B used to produce the cleaning agent portion.

A further preferred subject is therefore a claimed cleaning agent portion in which the composition comprises at least one part A that is compressed to a greater extent and at least one part B that is compressed to a lesser extent, and in which at least one part A was compressed at at least 8 kN/cm$^2$, particularly preferably at at least 10 kN/cm$^2$, in particular at at least 12 kN/cm$^2$, for example at 12 to 25 kN/cm$^2$.

Yet another preferred subject is therefore a claimed cleaning agent portion in which the composition comprises at least one compressed part A and at least one part B that is compressed to a lesser extent, and in which at least one compressed part B was compressed by 5 to 50%, preferably by 10 to 45%, particularly preferably by 15 to 40%, based on the bulk density of the non-compressed part B used to produce the cleaning agent portion and at least one part A that is compressed to a greater extent was compressed at at least 8 kN/cm$^2$, particularly preferably at at least 10 kN/cm$^2$, in particular at at least 12 kN/cm$^2$, for example at 12 to 25 kN/cm$^2$.

The cleaning and care compositions described herein contain pH regulators in the form of at least one acid and/or at least one buffer system containing at least one acid and at least one base. In general, polycarboxylic acids are suitable as acids, polycarboxylic acids being understood to mean those carboxylic acids which carry more than one acid function. These include, for example, oxalic acid, citric acid, adipic acid, succinic acid, glutaric acid, malic acid, tartaric acid, maleic acid, fumaric acid, saccharic acids, aminocarboxylic acids, nitrilotriacetic acid (NTA), provided that the use thereof is not objectionable for ecological reasons, and mixtures thereof. Corresponding buffer systems may contain one or more of the acids mentioned as well as the corresponding base(s) in each case and further bases. Citric acid or a buffer system consisting of citric acid and citrate can preferably be used.

Representatives of the aminocarboxylic acids include aspartic acid, methylglycinediacetic acid (MGDA), and glutamic diacetic acid (GLDA) or ethylenediaminediacetic acid. Iminodisuccinic acid (IDS) and iminodiacetic acid (IDA) are also suitable. However, it is preferable for the acids used to not be aminocarboxylic acids.

Suitable bases are all bases known from the prior art for dishwashing detergents. However, it is preferable for the base corresponding to the acid to be used in the buffer system consisting of an acid and a base, i.e. for example citrate if citric acid is used as the acid. Therefore, organic acids and their corresponding bases are preferably used. Carbonates and silicates in particular, which are described in more detail in the context of the builders that can additionally be used, are bases that can additionally be used, and the use of acetates is also possible.

The acids used and optionally also bases are preferably solid under standard conditions (temperature 25° C., pressure 1013 mbar) and can preferably be used in the form of a powder, in the microcrystalline form or in the form of granules.

It is also preferable for (i) the at least one acid to be an organic acid, in particular citric acid, and/or (ii) the buffer system to contain at least one organic acid, in particular citric acid, and the corresponding base, in particular citrate.

A further preferred subject is therefore a cleaning agent portion in which (i) the at least one acid is an organic acid, in particular citric acid, and/or (ii) the buffer system contains at least one organic acid, in particular citric acid, and the corresponding base, in particular citrate.

It is preferable for the acid from i) and/or ii) to be present in an amount suitable for reducing the amount of calcareous soiling in the dishwasher or for removing said soiling.

It is therefore preferable for the at least one acid from i) and/or ii) to be contained in the composition in an amount of 1 to 80 wt. %, preferably in an amount of 5 to 60 wt. %, particularly preferably in an amount of 20 to 35 wt. % or in an amount of 25 to 45 wt. %, based on the amount of the composition.

It is therefore also preferable for the absolute amount of the at least one acid from i) and/or ii) to be 0.2 to 16 g/job, preferably 3 to 11 g/job, particularly preferably 4 to 10 g/job, for example 4 to 7 g/job or 5 to 8 g/job.

It is therefore also preferable for the at least one acid from i) and/or ii) to be contained in an amount of 1 to 80 wt. %, preferably in an amount of 5 to 60 wt. %, particularly preferably in an amount of 20 to 35 wt. %, or in an amount of 25 to 45 wt. %, based on the total composition, and for the absolute amount of the at least one acid from i) and/or ii) in the total composition to be 0.2 to 16 g/job, preferably 3 to 11 g/job, particularly preferably 4 to 10 g/job, for example 4 to 7 g/job or 5 to 8 g/job.

A further preferred subject is therefore a cleaning agent portion in which the at least one acid from i) and/or ii) is contained in an amount of 1 to 80 wt. %, preferably in an amount of 5 to 60 wt. %, particularly preferably in an amount of 20 to 35 wt. %, or in an amount of 25 to 45 wt. %, based on the total composition, and/or the absolute amount of the at least one acid from i) and/or ii) in the total composition is 0.2 to 16 g/job, preferably 3 to 11 g/job, particularly preferably 4 to 10 g/job, for example 7 to 9 g/job.

These specified amounts are each based on the (crystal) water-free form.

If at least one buffer system ii) is contained in the composition, it is preferable for the base corresponding to the acid to be used. It is readily understood that the total amounts of acid and base in the buffer system have to be selected such that the desired pH range is achieved. This applies to both the pH range achieved by dissolving the acid and the pH range achieved by dissolving the buffer system and to the pH range obtained by dissolving the total composition. It is preferable in terms of the continuation of the rinsing cycle and the effect thereof for a pH of 3.0 to 7.0, particularly preferably 3.0 to 6.5, very particularly preferably 4.0 to 5.7, to be achieved in the present rinsing liquor, by completely dissolving the claimed composition, before the automatic dishwashing detergent is metered.

It is preferable for the acid from i) or ii) to be available as quickly as possible so as to clean and care for the dishwasher. To ensure this, it is preferable for 80 to 100 wt. %, in particular 95 to 100 wt. %, most preferably at least 99 wt. %, of the acid from i) or ii) to be contained in at least one part B, based on the amount of acid in the composition.

A further preferred subject is therefore a cleaning agent portion in which the acid from i) and/or ii) is contained in at least one part B that is compressed to a lesser extent, preferably in an amount of 80 to 100 wt. %, in particular 95 to 100 wt. %, most preferably at least 99 wt. %, based on the amount of acid in the total composition.

If a buffer system ii) is contained in the composition, according to a preferred embodiment, the at least one base contained in said buffer system is contained in part B in an amount of 40 to 75 wt. %, preferably 50 to 70 wt. %, in particular 60 to 69 wt. %, based on the total amount of base in the composition.

If a buffer system ii) is contained in the composition, according to a further preferred embodiment, the at least one base contained in said buffer system is contained in part B in an amount of at most 30 wt. %, preferably at most 15 wt. %, in particular at most 5 wt. %, based on the total amount of base in the composition.

If a buffer system ii) is contained in the composition, according to another preferred embodiment, the at least one base contained in said buffer system is contained in part B in an amount of at most 3 wt. %, preferably at most 1 wt. %, based on the total amount of base in the composition; in particular, there is no base contained in a part B.

Accordingly, in one embodiment, it is preferable for 25 to 60 wt. %, particularly preferably 30 to 50 wt. %, in particular 31 to 40 wt. %, of the base of the buffer system to be contained in at least one part A of the composition, based on the total amount of base in the composition.

Accordingly, in a further embodiment, it is preferable for at least 70 wt. %, preferably at least 85 wt. %, in particular at least 95 wt. %, of the base of the buffer system to be contained in at least one part A of the composition, based on the total amount of base in the composition.

Accordingly, in another embodiment, it is preferable for at least 97 wt. %, preferably at least 99 wt. %, of the base of the buffer system to be contained in at least one part A of the composition, based on the total amount of base in the composition, in particular if the base of the buffer system ii) is contained completely in at least one part A.

A further preferred subject is therefore a cleaning agent portion in which the at least one base of the buffer system ii) is contained in part B in an amount of 40 to 75 wt. %, preferably 50 to 70 wt. %, in particular 60 to 69 wt. %, based on the total amount of base in the total composition.

These specified amounts are each based on the (crystal) water-free form.

It is preferable for the active substances of the composition that are necessary for limescale removal to be dissolved as quickly as possible and for it to thus be possible for said substances to take effect before the automatic dishwashing detergent is added.

It is therefore preferable for the acid to be released as quickly as possible in order to obtain an acidic rinsing liquor. It is particularly preferable for the time to complete release of the acid of a cleaning agent portion having a mass of 20 g in 1 L of water at room temperature with stirring (in a 2 liter beaker having a diameter of 12 cm using a propeller stirrer having a diameter of 6 cm (blade of the stirrer at a height of 3 cm above the bottom of the beaker) at 200 rpm) to be 0.1 to 15 minutes, preferably 0.3 to 5 minutes, particularly preferably 0.5 to 2 minutes.

A further preferred subject is therefore a cleaning agent portion in which the time to complete release of the acid of 20 g of the claimed composition in 1 L of water at room temperature with stirring (in a 2 liter beaker having a diameter of 12 cm using a propeller stirrer having a diameter of 6 cm (blade of the stirrer at a height of 3 cm above the bottom of the beaker) at 200 rpm) is 0.1 to 15 minutes, preferably 0.3 to 5 minutes, particularly preferably 0.5 to 2 minutes.

For the same reason, it is also preferable for the cleaning agent portion to dissolve in 100 times the amount of water, based on the weight of the cleaning agent portion, such that, after stirring for 1 minute (in a 3 liter beaker having a diameter of 13.5 cm using a propeller stirrer having a diameter of 7 cm (blade of the stirrer at a height of 3.5 cm above the bottom of the beaker) at 200 rpm) at room temperature, a solution having a pH of 3 to 6.5, preferably 4 to 6, is obtained.

A further preferred subject is therefore a cleaning agent portion in which the cleaning agent portion is dissolved in 100 times the amount of water, based on the weight of the cleaning agent portion, such that, after stirring for 1 min (in a 3 liter beaker having a diameter of 13.5 cm using a propeller stirrer having a diameter of 7 cm (blade of the stirrer at a height of 3.5 cm above the bottom of the beaker) at 200 rpm) at room temperature, a solution having a pH of 3 to 6.5, preferably 4 to 6, is obtained.

So as to make it easier to remove or reduce the amount of fat soiling, in addition to removing or reducing the amount of limescale, it is preferable for at least one non-ionic surfactant to be contained in the composition. It is preferable for a mixture consisting of two or more non-ionic surfactants to be used in the composition.

A non-ionic surfactant that can be used in the cleaning and/or care agents described herein may be any of the non-ionic surfactants known to a person skilled in the art. In preferred embodiments, however, non-ionic surfactants from the group of alkoxylated alcohols are used. A class of non-ionic surfactants which can preferably be used and which can be used either as the sole non-ionic surfactant or in combination with other non-ionic surfactants are accordingly alkoxylated, preferably ethoxylated or ethoxylated and propoxylated, fatty alcohols.

Therefore, in various preferred embodiments, a fatty alcohol alkoxylate, in particular a fatty alcohol ethoxylate, is used. In particular, non-end-capped fatty alcohol alkoxylates are preferred.

In preferred embodiments, the fatty alcohol ethoxylate has the formula $$R^1—O-(EO)_m—H,$$

in which $R^1$ is a linear or branched, substituted or unsubstituted alkyl group having 12 to 24, in particular 14 to 20, more particularly 16 to 18, C atoms; EO is an ethylene oxide unit; and m is 10 to 50, in particular 20 to 30, preferably 22 to 27, in particular 25.

In particularly preferred embodiments, the fatty alcohol ethoxylate has the formula $$R^1—O-(EO)_m—H,$$

in which $R^1$ is a linear or branched, substituted or unsubstituted alkyl group having 16 to 18 C atoms; EO is an ethylene oxide unit; and m is 20 to 30, preferably 22 to 27, in particular 25.

In one embodiment, the alkyl group $R^1$ is a linear, preferably unsubstituted, alkyl group having 16 to 18 C atoms.

The fatty alcohol alkoxylate, preferably the fatty alcohol ethoxylate, in particular the fatty alcohol ethoxylate of the mentioned formulas, can be contained in the care agent in an amount of 0.1 to 20 wt. %, preferably 1 to 13 wt. %, particularly preferably 3 to 9 wt. %, based on the care agent. Such amounts are preferred so as to ensure that fat is dissolved and removed to an adequate degree.

It is preferable for a non-ionic surfactant that can be used in the cleaning and/or care agents described herein to be contained in the composition in an absolute amount of 0.1 to 4 g/job, preferably 1 to 3 g/job, in particular 1.2 to 2.2 g/job, for example 1.5 g/job.

It is particularly preferable for a fatty alcohol ethoxylate of formula $$R^1—O-(EO)_m—H,$$

in which $R^1$ is a linear or branched, substituted or unsubstituted alkyl group having 12 to 24, in particular 14 to 20, more particularly 16 to 18, C atoms; EO is an ethylene oxide unit; and m is 10 to 50, in particular 20 to 30, preferably 22 to 27, in particular 25, to be contained in the composition in an absolute amount of 0.1 to 4 g/job, preferably 1 to 3 g/job, in particular 1.2 to 2.2 g/job, for example 1.5 g/job.

It is particularly preferable for a fatty alcohol ethoxylate of formula $$R^1—O-(EO)_m—H,$$

in which $R^1$ is a linear or branched, substituted or unsubstituted alkyl group having 16 to 18 C atoms; EO is an ethylene oxide unit; and m is 20 to 30, preferably 22 to 27, in particular 25, to be contained in the composition in an absolute amount of 0.1 to 4 g/job, preferably 1 to 3 g/job, in particular 1.2 to 2.2 g/job, for example 1.5 g/job.

The non-ionic surfactant is preferably a fatty alcohol ethoxylate that is solid under standard conditions (temperature 25° C., pressure 1013 mbar) and can preferably be used in the form of a powder or granules.

Also suitable as the non-ionic surfactant is a fatty alcohol alkoxylate of formula $$R^2-(AO)_w—R^3,$$

in which $R^2$ represents a linear or branched, substituted or unsubstituted alkyl group having 8 to 16 C atoms; $R^3$ represents H or a linear or branched hydrocarbon functional group having 2 to 26 carbon atoms; each A independently represents a functional group selected from the group $—CH_2CH_2—$ and $—CH_2—CH(CH_3)—$, $CH_2—CH_2—CH_2—$, $CH_2—CH_2—CH_2—CH_2—$, $—CH_2—CH(CH_2—CH_3)—$, $—CH_2—C(CH_3)_2—$ or $—CH_2—CH_2—CH(CH_3)—$, with at least one A being $—CH_2CH_2—$ and at least one A being $—CH_2—CH(CH_3)—$, $CH_2—CH_2—CH_2—$, $CH_2—CH_2—CH_2—CH_2—$, $—CH_2—CH(CH_2—CH_3)—$, $—CH_2—C(CH_3)_2—$ or $—CH_2—CH_2—CH(CH_3)—$; and w represents an integer from 2 to 50, preferably 10 to 30.

In various embodiments, the ratio of the ethylene oxide units to the higher alkylene oxide units in the fatty alcohol alkoxylate of the formula is 12:1 to 1:1, preferably 10:1 to 2:1, in particular 6:1 to 3:1. Particularly preferred are those fatty alcohol alkoxylates of the formula in which $R^2$ is a linear alkyl group having 12-16 C atoms, $R^3$=H and w=10 to 30.

The fatty alcohol alkoxylate of this formula can be contained in the composition in particular in an amount of 0.01 to 3 wt. % based on the composition. The absolute amount of the fatty alcohol alkoxylate of this formula in the composition can be in particular 0.001 to 3 g/job, preferably 0.01 to 1 g/job, more preferably 0.1 to 0.5, very particularly preferably 0.2 g/job.

Suitable non-ionic surfactants also include alkyl glycosides of general formula $RO(G)_x$, for example, in which R corresponds to a primary linear or methyl-branched aliphatic functional group, in particular an aliphatic functional group that is methyl-branched in the 2 position, having 8 to 22, preferably 12 to 18, C atoms, and G is the symbol that represents a glycose unit having 5 or 6 C atoms, preferably glucose. The degree of oligomerization x, which indicates the distribution of monoglycosides and oligoglycosides, is any number between 1 and 10; x is preferably between 1.2 and 1.4.

Another class of non-ionic surfactants that can be used are alkoxylated, preferably ethoxylated or ethoxylated and propoxylated fatty acid alkyl esters, preferably having 1 to 4 carbon atoms in the alkyl chain.

Non-ionic surfactants of the amine oxide type, for example N-cocoalkyl-N,N-dimethylamine oxide and N-tallowalkyl-N,N-dihydroxyethylamine oxide, and of the fatty acid alkanolamide type may also be suitable. The amount of these non-ionic surfactants is preferably no more than that of the ethoxylated fatty alcohols, in particular no more than half thereof.

Additional suitable surfactants are the polyhydroxy fatty acid amides, known as PHFAs.

Finally, other low-foaming non-ionic surfactants from the group of alkoxylated alcohols can also be used.

A further preferred subject is therefore a cleaning agent portion in which the composition contains non-ionic surfactant, preferably in an amount of 0.1 to 20 wt. %, particularly preferably 5 to 17 wt. %, more particularly preferably 7 to 15 wt. %, based on the total amount of composition. In addition, it is preferable for mixtures of different non-ionic surfactants to be used.

A further preferred subject is therefore a cleaning agent portion in which the composition contains non-ionic surfactant, the non-ionic surfactant being a fatty alcohol ethoxylate of formula $$R^1—O-(EO)_m—H,$$

in which $R^1$ is a linear or branched, substituted or unsubstituted alkyl group having 16 to 18 C atoms; EO is an ethylene oxide unit; and m is 20 to 30, preferably 22 to 27, in particular 25, preferably in an amount of 0.1 to 20 wt. %, particularly preferably 5 to 16 wt. %, more particularly preferably 6 to 14 wt. %, based on the total amount of composition.

The compositions of the cleaning agent portions according to the invention may contain further components, preferably at least one further component, preferably selected from the group consisting of further builders, surfactants, polymers, enzymes, corrosion inhibitors, glass corrosion inhibitors, thickeners, foam inhibitors, dyes, disintegration aids, fragrances and perfume carriers, preferably one or more polymers.

Preferred anionic surfactants are fatty alcohol sulfates, fatty alcohol ether sulfates, dialkyl ether sulfates, monoglyceride sulfates, alkylbenzene sulfonates, olefin sulfonates, alkane sulfonates, ether sulfonates, n-alkyl ether sulfonates, ester sulfonates and lignosulfonates. Fatty acid cyanamides, sulfosuccinates (sulfosuccinic acid esters), in particular sulfosuccinic acid mono- and dialkyl esters having 8 to 18 C atoms, sulfosuccinamates, sulfosuccinamides, fatty acid isethionates, acylamino alkane sulfonates (fatty acid taurides), fatty acid sarcosinates, ether carboxylic acids and alkyl (ether) phosphates, and α-sulfo fatty acid salts, acylglutamates, monoglyceride disulfates and alkyl ethers of glycerol disulfate can also be used within the scope of the present invention.

The anionic surfactants are preferably used as sodium salts, but can also be contained as other alkali or alkaline-earth metal salts, for example potassium or magnesium salts, and in the form of ammonium salts or mono-, di-, tri- or tetraalkylammonium salts, and in the case of the sulfonates also in the form of their corresponding acids, e.g. dodecylbenzenesulfonic acid.

The builders that can additionally be used include in particular carbonates, organic cobuilders and silicates.

It is possible, for example, to use carbonate(s) and/or hydrogen carbonate(s), preferably alkali carbonate(s), particularly preferably sodium carbonate. In various embodiments, alkali carbonates, in particular sodium carbonate, can be contained in the composition in an amount of 1 to 40 wt. %, preferably 2 to 30 wt. %, based on the total weight of the composition.

Polycarboxylates/polycarboxylic acids, polymeric carboxylates, aspartic acid, polyacetals and dextrins are particularly noteworthy as cobuilders.

Organic builders that can be used are the polycarboxylic acids that can be used in the form of the free acids and/or the sodium salts thereof, for example, with polycarboxylic acids being understood to mean those carboxylic acids which carry more than one acid function. These include, for example, citric acid, adipic acid, succinic acid, glutaric acid, malic acid, tartaric acid, maleic acid, fumaric acid, saccharic acids, aminocarboxylic acids, nitrilotriacetic acid (NTA), provided that the use thereof is not objectionable for ecological reasons, and mixtures thereof.

In a possible use of said builders in the composition and/or in the cleaning agent portion, the influence thereof on the buffer system that may be present should be taken into account.

Polymeric polycarboxylates are also suitable as builders. These are, for example, the alkali metal salts of polyacrylic acid or polymethacrylic acid, for example those having a relative molecular mass of 500 to 70,000 g/mol.

Homopolymers, copolymers and terpolymers can be used; more complex types of polymers are also possible. Suitable polymers are in particular polyacrylates and/or copolymers and/or terpolymers which contain acrylate monomers and preferably have a molecular mass of 1,000 to 20,000 g/mol. Due to their superior solubility, the short-chain polyacrylates, which have molar masses of 1,000 to 10,000 g/mol, and particularly preferably 3,000 to 5,000 g/mol, can in turn be preferred from this group.

A copolymeric polyacrylate, preferably a sulfopolymer, preferably a copolymeric polysulfonate, preferably a hydrophobically modified copolymeric polysulfonate, is preferably used as the polycarboxylate. The copolymers can have two, three, four, or more different monomer units. Preferred copolymeric polysulfonates contain, besides sulfonic acid group-containing monomer(s), at least one monomer from the group of unsaturated carboxylic acids.

As the unsaturated carboxylic acid(s), unsaturated carboxylic acids of formula $R^1(R^2)C{=}C(R^3)COOH$ are particularly preferably used, in which $R^1$ to $R^3$, independently of one another, represent —H, $—CH_3$, a straight-chain or branched saturated alkyl functional group having 2 to 12 carbon atoms, a straight-chain or branched, mono- or polyunsaturated alkenyl functional group having 2 to 12 carbon atoms, alkyl or alkenyl functional groups substituted with $—NH_2$, —OH or —COOH as defined above, or represent —COOH or $—COOR^4$, where $R^4$ is a saturated or unsaturated, straight-chain or branched hydrocarbon functional group having 1 to 12 carbon atoms.

Particularly preferred unsaturated carboxylic acids are acrylic acid, methacrylic acid, ethacrylic acid, α-chloroacrylic acid, α-cyanoacrylic acid, crotonic acid, α-phenylacrylic acid, maleic acid, maleic anhydride, fumaric acid, itaconic acid, citraconic acid, methylene malonic acid, sorbic acid, cinnamic acid, or mixtures thereof. Unsaturated dicarboxylic acids can obviously also be used.

For sulfonic acid group-containing monomers, those of formula $R^5(R^6)C{=}C(R^7)—X—SO_3H$ are preferred, in which $R^5$ to $R^7$, independently of one another, represent —H, $—CH_3$, a straight-chain or branched saturated alkyl functional group having 2 to 12 carbon atoms, a straight-chain or branched, mono- or polyunsaturated alkenyl functional group having 2 to 12 carbon atoms, alkyl or alkenyl functional groups substituted with $—NH_2$, —OH, or —COOH, or represent —COOH or $—COOR^4$, where $R^4$ is a saturated or unsaturated, straight-chain or branched hydrocarbon functional group having 1 to 12 carbon atoms, and X represents an optionally present spacer group that is selected from $—(CH_2)_n$, where n=0 to 4, $—COO—(CH_2)_k—$, where k=1 to 6, $—C(O)—NH—C(CH_3)_2—$, $—C(O)—NH—C(CH_3)_2—CH_2—$ and $—C(O)—NH—CH(CH_3)—CH_2—$.

Among these monomers, those of formulas $H_2C{=}CH—X—SO_3H$, $H_2C{=}C(CH_3)—X—SO_3H$ or $HO_3S—X—(R^6)C{=}C(R^7)—X—SO_3H$ are preferred, in which $R^6$ and $R^7$, independently of one another, are selected from —H, $—CH_3$, $—CH_2CH_3$, $—CH_2CH_2CH_3$ and $—CH(CH_3)_2$, and X represents an optionally present spacer group that is selected from $—(CH_2)_n—$, where n=0 to 4, —COO—

$(CH_2)_k$—, where k=1 to 6, —C(O)—NH—$C(CH_3)_2$—, —C(O)—NH—$C(CH_3)_2$—$CH_2$— and —C(O)—NH—CH$(CH_3)$—$CH_2$—.

According to a particularly preferred embodiment, a polymer comprising, as a sulfonic acid group-containing monomer, acrylamidopropanesulfonic acids, methacrylamidomethylpropanesulfonic acids or acrylamidomethylpropanesulfonic acid can be contained.

Particularly preferred sulfonic acid group-containing monomers are 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allyl sulfonic acid, methallyl sulfonic acid, allyloxybenzene sulfonic acid, methallyloxybenzene sulfonic acid, 2-hydroxy-3-(2-propenyloxy)propanesulfonic acid, 2-methyl-2-propene-1-sulfonic acid, styrene sulfonic acid, vinylsulfonic acid, 3-sulfopropyl acrylate, 3-sulfopropyl methacrylate, sulfomethacrylamide, sulfomethylmethacrylamide, as well as mixtures of the above acids or water-soluble salts thereof. The sulfonic acid groups can be present in the polymers fully or partially in neutralized form, i.e. the acidic hydrogen atom of the sulfonic acid group can be replaced in some or all of the sulfonic acid groups with metal ions, preferably alkali metal ions, and in particular with sodium ions. The use of partially or fully neutralized sulfonic acid group-containing copolymers is preferred according to the invention.

In copolymers that contain only carboxylic acid group-containing monomers and sulfonic acid group-containing monomers, the monomer distribution of the copolymers that are preferably used according to the invention is preferably 5 to 95 wt. % in each case; particularly preferably, the proportion of the sulfonic acid group-containing monomers is 50 to 90 wt. %, and the proportion of the carboxylic acid group-containing monomers is 10 to 50 wt. %, with the monomers preferably being selected from those mentioned above. The molar mass of the sulfo-copolymers that are preferably used according to the invention can be varied in order to adapt the properties of the polymers to the desired intended use. Preferred cleaning agents are characterized in that the copolymers have molar masses of 2,000 to 200,000 $g \cdot mol^{-1}$, preferably 4,000 to 25,000 $g \cdot mol^{-1}$, and in particular 5,000 to 15,000 $g \cdot mol^{-1}$.

In another preferred embodiment, the copolymers comprise not only carboxyl group-containing monomers and sulfonic acid group-containing monomers but also at least one non-ionic, preferably hydrophobic monomer.

Particularly preferably, in one embodiment, an anionic copolymer can be contained, a copolymer comprising i) carboxylic acid group-containing monomers
ii) sulfonic acid group-containing monomers
iii) non-ionic monomers, particularly hydrophobic monomers being used as the anionic copolymer.

As the non-ionic monomers, monomers of general formula $R^1$ $(R^2)C{=}C(R^3)$—X—$R^4$ are preferably used, in which $R^1$ to $R^3$, independently of one another, represent —H, —$CH_3$ or —$C_2H_5$, X represents an optionally present spacer group selected from —$CH_2$—, —C(O)O— and —C(O)—NH—, and $R^4$ represents a straight-chain or branched saturated alkyl functional group having 2 to 22 carbon atoms or an unsaturated, preferably aromatic functional group having 6 to 22 carbon atoms.

Particularly preferred non-ionic monomers are butene, isobutene, pentene, 3-methylbutene, 2-methylbutene, cyclopentene, hexene, hexene-1, 2-methlypentene-1, 3-methlypentene-1, cyclohexene, methylcyclopentene, cycloheptene, methylcyclohexene, 2,4,4-trimethylpentene-1, 2,4,4-trimethylpentene-2,2,3-dimethylhexene-1, 2,4-dimethylhexene-1, 2,5-dimethylhexene-1, 3,5-dimethylhexene-1, 4,4-dimethylhexane-1, ethylcyclohexene, 1-octene, α-olefins having 10 or more carbon atoms such as 1-decene, 1-dodecene, 1-hexadecene, 1-octadecene and C22 α-olefin, 2-styrene, α-methylstyrene, 3-methylstyrene, 4-propylstyrene, 4-cyclohexylstyrene, 4-dodecylstyrene, 2-ethyl-4-benzylstyrene, 1-vinyl naphthalene, 2-vinyl naphthalene, acrylic acid methyl ester, acrylic acid ethyl ester, acrylic acid propyl ester, acrylic acid butyl ester, acrylic acid pentyl ester, acrylic acid hexyl ester, methacrylic acid methyl ester, N-(methyl)acrylamide, acrylic acid-2-ethylhexyl ester, methacrylic acid-2-ethylhexyl ester, N-(2-ethylhexyl)acrylamide, acrylic acid octyl ester, methacrylic acid octyl ester, N-(octyl)acrylamide, acrylic acid lauryl ester, methacrylic acid lauryl ester, N-(lauryl)acrylamide, acrylic acid stearyl ester, methacrylic acid stearyl ester, N-(stearyl)acrylamide, acrylic acid behenyl ester, methacrylic acid behenyl ester, and N-(behenyl)acrylamide or mixtures thereof, in particular acrylic acid, ethyl acrylate, 2-acrylamido-2-methylpropanesulfonic acid (AMPS) as well as mixtures thereof.

Polyacrylate-containing polymers can be contained in the composition in amounts of 0.5 to 15 wt. %, preferably 0.6 to 10 wt. %, particularly preferably in amounts of 0.8 to 3 wt. %, or 1 to 5 wt. %, based on the total weight of the composition. It is also possible to use mixtures of different polymers.

The agents can also contain, as a builder, crystalline layered silicates of general formula $NaMSi_xO_{2x+1} \cdot y\ H_2O$, where M represents sodium or hydrogen, x is a number from 1.9 to 22, preferably 1.9 to 4, with 2, 3, or 4 being particularly preferred values for x, and y represents a number from 0 to 33, preferably 0 to 20. Amorphous sodium silicates with an $Na_2O{:}SiO_2$ modulus of 1:2 to 1:3.3, preferably 1:2 to 1:2.8, and in particular 1:2 to 1:2.6, can also be used which preferably exhibit retarded dissolution and secondary washing properties. In preferred agents, the silicate content, based on the total weight of the composition, is limited to amounts below 10 wt. %, preferably below 7 wt. %, and in particular below 5 wt. %. Particularly preferred compositions of the cleaning agent portion contain silicate as a builder. Very particularly preferred compositions contain silicate in part A in the stated amount range, based on the total weight of the composition. Furthermore, it is preferable for the amount of silicate, based on the mass of part A, to be between 5 and 50 wt. %, preferably between 10 and 30 wt. %, very particularly preferably between 15 and 25 wt. %.

Individual odorant compounds, such as the synthetic products of the ester, ether, aldehyde, ketone, alcohol, and hydrocarbon types, can be used as perfume oils or fragrances within the scope of the present invention. However, mixtures of different odorants are preferably used which together produce an appealing fragrance note. Perfume oils of this kind may also contain natural odorant mixtures which can be obtained from plant sources such as pine, citrus, jasmine, patchouli, rose or ylang-ylang oil.

In preferred embodiments, the cleaning agent portion and/or the composition is phosphate-free and/or phosphonate-free. "Phosphate-free" and "phosphonate-free," as used herein, means that the composition in question is substantially free of phosphates or phosphonates, i.e. contains in particular phosphates or phosphonates in amounts of less than 0.1 wt. %, preferably less than 0.01 wt. %, based on the total portion. It is preferable for a total amount of phosphorus of 0.3 g per job, preferably 0.03 g, to not be exceeded.

A further preferred subject is therefore a cleaning agent portion in which the cleaning agent portion is phosphate-free and/or phosphonate-free.

In further possible embodiments, the agent can contain bleach or be bleach-free. According to a preferred embodiment, a bleaching agent is contained in the agent, particularly preferably in part A, more particularly preferably only in part A. A preferred bleaching agent is an alkali metal percarbonate, preferably sodium percarbonate. In these preferred embodiments, a bleaching agent, preferably sodium percarbonate, can be contained in part A in an amount of 1 to 50 wt. %, preferably 5 to 30 wt. % or 10 to 40 wt. %, based on the total weight of part A.

It is also preferable that the above-described compositions for cleaning and/or caring for an automatic dishwasher can be used in a normal cleaning cycle, which is carried out so as to clean washware, in particular dirty dishes, and in which a machine dishwashing detergent is also used.

It is possible for the claimed cleaning agent portion to be composed such that an acidic rinsing liquor is initially obtained during the pre-rinse. In the following, for example, if a buffer system is contained in the composition, the pH of the rinsing liquor can be increased by progressively dissolving the composition. It is preferable in terms of the continuation of the rinsing cycle for a pH of 3.0 to 7.0, particularly preferably 3.0 to 6.5, very particularly preferably 4.6 to 5.7, to be achieved in the present rinsing liquor, by completely dissolving the claimed composition, before the automatic dishwashing detergent is metered.

The cleaning agent portions and/or care agents described herein can be formulated in different ways. The at least one part B may be present in a solid or liquid product format or in a combination of solid and liquid product formats. Powder and granules are particularly suitable as solid formats. The water- and/or organic solvent-based liquid product formats may be present in thickened form, namely in the form of gels.

In preferred embodiments, the care agent is in a product format in which both at least one part A and at least one part B are solid. "Solid" means in this context that the part is in solid form under standard conditions (temperature 25° C., pressure 1013 mbar). In various embodiments, an optionally present surfactant and/or the at least one acid or the buffer system is in a solid state at 25° C. (pressure 1013 mbar), for example as a powder or granules, and, when processed with the other components of the solid care agent, does not reduce the flowability of the produced care agent and can therefore be incorporated in any amounts.

To make use easier for the consumer and to ensure correct dosing, the composition is in a pre-portioned form. This may be any form of packaging which is in line with the conditions mentioned above. Compositions which are present, for example, in the form of a multiphase tablet or a multiphase pouch are preferred. In both multiphase tablets and multiphase pouches, the different phases can be both one above the other and one next to the other, or simultaneously one above the other and one next to the other.

To make use easier, the composition is in a water-soluble wrapping. It is particularly preferable for the water-soluble packaging to be a polyvinyl alcohol-containing film.

It is preferable for the water-soluble wrapping to contain polyvinyl alcohol or a polyvinyl alcohol copolymer. Water-soluble wrappings containing polyvinyl alcohol or a polyvinyl alcohol copolymer exhibit good stability with a sufficiently high level of water solubility, in particular cold-water solubility.

Suitable water-soluble films for producing the water-soluble wrapping are preferably based on a polyvinyl alcohol or a polyvinyl alcohol copolymer of which the molecular weight is in the range of 10,000 to 1,000,000 $gmol^{-1}$, preferably 20,000 to 500,000 $gmol^{-1}$, particularly preferably 30,000 to 100,000 $gmol^{-1}$ and in particular 40,000 to 80,000 $gmol^{-1}$.

Polyvinyl alcohol is usually prepared by hydrolysis of polyvinyl acetate, since the direct synthesis route is not possible. The same applies to polyvinyl alcohol copolymers, which are prepared accordingly from polyvinyl acetate copolymers. It is preferable for at least one layer of the water-soluble wrapping to include a polyvinyl alcohol of which the degree of hydrolysis is 70 to 100 mol. %, preferably 80 to 90 mol. %, particularly preferably 81 to 89 mol. %, and in particular 82 to 88 mol. %.

In addition, a polymer selected from the group including (meth)acrylic acid-containing (co)polymers, polyacrylamides, oxazoline polymers, polystyrene sulfonates, polyurethanes, polyesters, polyethers, polylactic acid or mixtures of said polymers may be added to a polyvinyl alcohol-containing film material that is suitable for producing the water-soluble wrapping. Polylactic acids are a preferred additional polymer.

Preferred polyvinyl alcohol copolymers include, in addition to vinyl alcohol, dicarboxylic acids as further monomers. Suitable dicarboxylic acids are itaconic acid, malonic acid, succinic acid and mixtures thereof, with itaconic acid being preferred.

Polyvinyl alcohol copolymers which are also preferred include, in addition to vinyl alcohol, an ethylenically unsaturated carboxylic acid, or the salt or ester thereof. Polyvinyl alcohol copolymers of this kind particularly preferably contain, in addition to vinyl alcohol, acrylic acid, methacrylic acid, acrylic acid ester, methacrylic acid ester or mixtures thereof.

It may be preferable for the film material to contain further additives. The film material may contain plasticizers such as dipropylene glycol, ethylene glycol, diethylene glycol, propylene glycol, glycerol, sorbitol, mannitol or mixtures thereof, for example. Further additives include, for example, release aids, fillers, cross-linking agents, surfactants, antioxidants, UV absorbers, anti-blocking agents, anti-adhesive agents or mixtures thereof.

Suitable water-soluble films for use in the water-soluble wrappings of the water-soluble packaging according to the invention are films which are sold by MonoSol LLC, for example under the names M8630, C8400 or M8900. Other suitable films include films named Solublon® PT, Solublon® GA, Solublon® KC or Solublon® KL from Aicello Chemical Europe GmbH, or the VF-HP films from Kuraray.

Furthermore, it is preferable for the composition to be used in an amount of 10 to 30 g/job, preferably 13 to 23 g/job, in particular 15 to 21 g/job.

The composition may be formulated such that the at least one part A and the at least one part B are present in the composition in a weight ratio of 3:1 to 1:10, preferably in a weight ratio of 1:1 to 1:8, in particular 1:3 to 1:7, for example 1:4 to 1:6, based on the amounts of part A and part B, respectively.

A preferred embodiment is a cleaning agent portion comprising a water-soluble wrapping and at least one composition for cleaning and/or caring for an automatic dishwasher, the composition containing at least one buffer system consisting of at least one acid and at least one base, the composition comprising at least two parts, at least one part A being a compressed part and at least one part B being a non-compressed part or a further compressed part, an optionally compressed part B being compressed to a lesser extent than part A, and at least one compressed part B having been compressed by 10 to 45%, preferably by 15 to 40%, based on the bulk density of the non-compressed part B used to produce the cleaning agent portion and at least one part A that is compressed to a greater extent having been compressed at at least 8 kN/cm$^2$, particularly preferably at at least 10 kN/cm$^2$, in particular at at least 12 kN/cm$^2$, for example at 12 to 25 kN/cm$^2$, and the at least one base, which is contained in said buffer system, being contained in part B in an amount of 40 to 75 wt. %, preferably 50 to 70 wt. %, in particular 60 to 69 wt. %, based on the total amount of base in the composition and the composition containing non-ionic surfactant, preferably in an amount of 5 to 17 wt. %, particularly preferably 7 to 15 wt. %, based on the total amount of composition and the composition being used in an amount of 10 to 30 g/job, preferably 13 to 23 g/job, in particular 15 to 21 g/job.

A further preferred embodiment is a cleaning agent portion comprising a water-soluble wrapping and at least one composition for cleaning and/or caring for an automatic dishwasher, the composition containing at least one buffer system consisting of at least one acid and at least one base, the composition comprising at least two parts, at least one part A being a compressed part and at least one part B being a non-compressed part, the at least one base, which is contained in said buffer system, being contained in part B in an amount of 40 to 75 wt. %, preferably 50 to 70 wt. %, in particular 60 to 69 wt. %, based on the total amount of base in the composition, the composition containing non-ionic surfactant, preferably in an amount of 5 to 17 wt. %, particularly preferably 7 to 15 wt. %, based on the total amount of composition, and the composition being used in an amount of 10 to 30 g/job, preferably 13 to 23 g/job, in particular 15 to 21 g/job.

The present invention further relates to a method for producing cleaning agent portions, comprising:

a) providing a mold having at least one mold cavity;
b) adding a water-soluble film to the mold cavity;
c) forming an open chamber in the mold cavity by deforming the water-soluble film;
d) filling the open chamber with at least one particulate part B according to this application;
e) optionally increasing the bulk density of the particulate part B by 5 to 50%, preferably by 10 to 45%, particularly preferably by 15 to 40%, based on the bulk density of the non-compressed part B used to produce the cleaning agent portion;
f) optionally forming a cavity in part B;
g) filling the open chamber and/or the cavity in part B with at least one part A according to this application;
h) providing a second water-soluble film as a cover;
i) superimposing the open chamber and the cover in order to seal the portion pack at a sealing region;
j) sealing the cover with the open chamber.

The mold comprises at least one cavity (mold cavity). For example, the mold may be provided as a single mold or as part of an array of molds in the form of a conveyor belt, as is known from the conveyor belt method and from the drum method. The mold comprises a region on which the film can be placed, e.g. a seal region which is typically defined around the opening in a mold cavity. The mold cavity can have different geometries; if there are edges, it is advantageous for them to be rounded. Rounded edges and/or dome-shaped cavities are designed to ensure that the film is pulled somewhat more homogeneously upon being pulled into the cavity, thereby keeping the film thickness uniform in this respect, and that no breakage or tear points are produced, which in turn results in a more stable portion pack.

The water-soluble film can be fed from a roll and onto the mold cavity. The film is positioned and held in place on the mold. The film can be held in place by means of suction holes on the mold surface, which is not part of the mold cavity. However, the film can also be held on the mold by mechanical means, for example clips. For example, the film may be held in place by a stamp which presses on the seal region. In continuous production methods, e.g. drum methods and conveyor belt methods, it is preferable for the speed of the film to be matched to the speed of the conveyor belt formed from the molds, such that the film is not unnecessarily pulled thinner on account of being held in place on a running mold.

After the film is held in place relative to the mold cavity, a chamber is formed in the mold cavity region by adapting the film at least in part to the mold cavity. The film is adapted by means of elastic and/or plastic deformation. Preferably, the film deformation has a greater plastic than elastic proportion. The deformation of the water-soluble film is produced for example by deep-drawing or by means of a suitable stamp. A preferred variant is deep-drawing, by applying negative pressure (forming pressure) in the mold cavity; for this purpose, the mold cavity preferably comprises small openings, preferably in the bottom region, which are connected in terms of air pressure to a vacuum pump by means of corresponding lines.

After forming the open chamber, said chamber or parts thereof are filled in step d) with at least one particulate part B. Subsequently, the particulate part can be compressed in an optional step e). It is preferable for the particulate part B to be compressed by 5 to 50%, preferably by 10 to 45%, particularly preferably by 15 to 40%, based on the bulk density of the non-compressed part B used to produce the cleaning agent portion. In one embodiment, it is preferable for the method to comprise a step e).

Simultaneously to the optional step e), subsequent thereto or with said step omitted, a cavity can be formed in a step f) in the particulate part B or the compressed part B or the part B being compressed. In one embodiment, it is preferable for the method to comprise both a step e) and a step f), with it being particularly preferable for these steps to be carried out simultaneously.

Step g) involves filling the open chamber and/or the optional cavity in the particulate part B with at least one part A. It is possible for part A to be fixed in the optional cavity or on the particulate composition B, for example by gluing. In a preferred embodiment, fixing of the at least one part A is omitted in this step.

In addition to the method(s) already described, another possible embodiment is a method in which part A and part B are introduced into the open chamber in a different order.

One possible embodiment is therefore a method for producing cleaning agent portions, comprising:

a) providing a mold having at least one mold cavity;
b) adding a water-soluble film to the mold cavity;
c) forming an open chamber in the mold cavity by deforming the water-soluble film;
d) filling the open chamber with at least one part A according to this application;
e) filling the open chamber with at least one particulate part B according to this application;
f) optionally increasing the bulk density of the particulate part B by 5 to 50%, preferably by 10 to 45%, particularly preferably by 15 to 40%, based on the bulk density of the non-compressed part B used to produce the cleaning agent portion;

g) optionally forming a cavity in part B;

h) optionally filling the open chamber and/or the cavity in part B with a further part A according to this application;

i) providing a second water-soluble film as a cover;

j) superimposing the open chamber and the cover in order to seal the portion pack at a sealing region;

k) sealing the cover with the open chamber.

When filling with product, the deformed film is preferably still held in the cavity during filling. For example, when negative pressure is applied, the negative pressure is broken only after sealing. In this case, the negative pressure after forming the chamber, in relation to the forming pressure, may have a lower strength (higher pressure), which fulfils only the holding function.

The chamber is filled by introducing at least one part A and at least one part B, in particular by those described above as being in accordance with the invention.

It is important for the seal region to remain free of product. For example, if the chamber is at least partly elastically deformed, this elastic deformation, after filling and prior to sealing, should not be such that the product flows over and out of the open chamber and thus contaminates the seal region.

According to a particular embodiment, the cover is positioned on the open chamber such that in the next step the cover can be placed on the sealing region. The position of the cover is generally determined relative to the position of the chamber. If the chamber moves together with a movable mold on a conveyor belt, the cover has to move in the same way so that the position relative to the chamber remains the same.

The cover is then placed onto the open chamber, which is closed in this way. The contact between the cover and the film in the sealing region thus closes the chamber. A preferred embodiment of the seal is a material fusion between the film and the cover, for example by solvating the film before applying the cover, or by melting the film and/or cover in the sealing region. Alternatively, the sealing is carried out by gluing or welding.

The positioning, applying, and sealing can take place either in separate steps or simultaneously.

It is particularly preferable for the cover to be provided as part of a strip, by feeding/transferring a strip that comprises at least one cover. Separating the cover may take place prior to positioning, after positioning but before being placed on, while being placed on, or after being placed onto the chamber.

When separated before positioning, the cover is preferably punched out. The cover and the film may also be separated at the same time as the sealing. The device which produces the seal by melting consists of at least two parts: one is the mold itself and the other is a counter-stamp which presses on the mold from the cover side. It is preferred that, in the sealing step, the pressure exerted during sealing at the sealing region by the mold and a further part must be lower than the pressure exerted in the separation region. The separation region surrounds the sealing region.

In the case of separation after sealing, the cover and film are alternatively preferably separated from the strip in the same step, and thus the portion packs are separated.

The present invention further relates to a method for cleaning and/or caring for an automatic dishwasher using the claimed cleaning agent portion, wherein the cleaning agent portion is dosed into the interior of the automatic dishwasher at the beginning of the cleaning cycle, preferably before the automatic dishwashing detergent.

It is preferable in terms of the continuation of the rinsing cycle and the effect thereof for a pH of 3.0 to 7.0, particularly preferably 3.0 to 6.5, very particularly preferably 4.6 to 5.7, to be achieved in the present rinsing liquor, by completely dissolving the claimed composition, before the automatic dishwashing detergent is metered.

In this case, metering or dosing into the interior of the dishwasher means that the cleaning agent portion or the automatic dishwashing detergent enters the interior of the dishwasher, for example by manual insertion, by optionally program-controlled opening of the metering flap and/or by automatic addition from an automatic metering device. It is possible for the cleaning agent portion or the automatic dishwashing detergent to be completely available in the rinsing liquor for cleaning and/or care purposes immediately or only after a period of time. This is dependent on the dissolution rate and thus on the type, composition and nature of the agent or composition. The dissolution process is not part of the metering or dosing process according to the definition given here. The dissolution process of an optionally present water-soluble wrapping, for example a film, is not part of the process for metering or dosing the cleaning agent portion or automatic dishwashing detergent either.

Metering at the beginning of the cleaning cycle can allow the composition of the cleaning agent portion to contribute to the cleaning and/or care of the dishwasher as early as in the pre-rinse and/or at the beginning of the main rinse. Subsequent metering of an automatic dishwashing detergent can help to maintain the conditions necessary for cleaning and/or caring for the dishwasher.

In the following practical example, the composition in the cleaning agent portion according to the invention is described in a non-limiting manner.

EXAMPLES

Two example compositions of a cleaning agent portion according to the invention are listed below. All amounts specified are in weight percentage based on the total amount of composition.

Example 1

| | Wt. % |
|---|---|
| Part A, m = 2.5 g | |
| Silicate | 3.0 to 4.0 |
| Non-ionic surfactant[1] | 1.0 to 2.5 |
| Sodium citrate dihydrate | 7 to 13 |
| Acrylate-containing polymer[2] | 0.5 to 2 |
| Percarbonate | 0 to 8 |
| Water, dye | 0.1 to 0.5 |
| Part B, m = 13 g | |
| Non-ionic surfactant[3], flakes | 7 to 15 |
| Sodium citrate anhydrate | 20 to 40 |
| Citric acid anhydrate | 25 to 45 |
| Perfume, other | 6 to 8 |

Example 2

| | Wt. % |
|---|---|
| Part A, m = 3.0 g | |
| Silicate | 3.0 to 4.0 |
| Non-ionic surfactant[1] | 1.0 to 2.5 |
| Sodium citrate dihydrate | 7 to 13 |
| Acrylate-containing polymer[2] | 0.5 to 2 |
| Percarbonate | 0 to 8 |
| Water, dye | 0.1 to 0.5 |
| Part B, m = 13 g | |
| Non-ionic surfactant[3], flakes | 7 to 15 |
| Sodium citrate anhydrate | 20 to 40 |
| Citric acid anhydrate | 25 to 45 |
| Perfume, other | 6 to 8 |

What is claimed is:

1. A cleaning agent for removing limescale and fats deposited on an automatic dishwasher machine comprising a water-soluble wrapping forming a single chamber and at least one composition, the composition comprising at least i) a buffer system consisting of at least one acid and at least one base corresponding to the acid, characterized in that the composition comprises at least two parts, at least one part A being a compressed part and at least one part B being a non-compressed part or a compressed part, the compressed part B being compressed to a lesser extent than part A; wherein the non-compressed part is in the form of a gel, powder, or granule, and the at least one acid of the buffer system is contained in at least one part B in an amount of 80 to 100 wt % based on the amount of acid in total composition, or wherein the at least one base of the buffer system is contained in the at least one part B in an amount of 40 to 75 wt % based on the total amount of based in the total composition, wherein the at least one part A and the at least one part B have a weight ratio of 1:3 to 1:7;

wherein the at least one part A dissolves in a delayed manner with respect to the at least one part B; and wherein the composition is encapsulated in the single chamber of the wrapping.

2. The cleaning agent according to claim 1, wherein the at least one acid is an organic acid.

3. The cleaning agent according to claim 1, wherein the at least one acid is contained in an amount of 1 to 80 wt. % based on the total composition, and/or the absolute amount of the at least one acid in the total composition is 0.2 to 16 g/job.

4. The cleaning agent according to claim 1, wherein the composition comprises at least one compressed part A and at least one part B that is compressed to a lesser extent, at least one compressed part B having been compressed by 5 to 50% based on the bulk density of the non-compressed part B used to produce the cleaning agent and/or at least one part A that is compressed to a greater extent having been compressed at at least 8 $kN/cm^2$.

5. The cleaning agent according to claim 1, wherein the composition contains non-ionic surfactant in an amount of 0.1 to 20 wt. % based on the total amount of composition.

6. The cleaning agent according to claim 1, wherein the cleaning agent can be used together with a machine dishwashing detergent in a normal cleaning cycle so as to clean the dishwasher machine and clean dirty dishware in the dishwasher simultaneously.

7. The cleaning agent according to claim 1, wherein the composition weighs 15 to 21 g, such that dosing for cleaning is 15 to 21 g/job.

8. The cleaning agent according to claim 1, wherein the cleaning agent is phosphate-free and/or phosphonate-free.

9. The cleaning agent according to claim 1, wherein the at least one part A and the at least one part B are present in the composition in a weight ratio of 1:4 to 1:6 based on the amounts of part A and part B, respectively.

10. The cleaning agent according to claim 2, wherein the at least one acid is citric acid.

11. The cleaning agent according to claim 1, wherein at least 97 wt. % of the base of the buffer system is contained in at least one part A of the total composition, based on the total amount of base in the composition.

12. The cleaning agent according to claim 1, wherein the buffer system is present in an amount of 45 to 85 wt. % based on the total composition.

13. The cleaning agent according to claim 1, wherein the cleaning agent is used prior to a normal cleaning cycle in which a machine dishwashing detergent is used for cleaning dirty dishes in the dishwasher.

* * * * *